US005756930A

United States Patent [19]

Chan et al.

[11] Patent Number: 5,756,930

[45] Date of Patent: May 26, 1998

[54] PROCESS FOR THE PREPARATION OF GAS-GENERATING COMPOSITIONS

[75] Inventors: Sek Kwan Chan, St Bruno; Noel Yu Wee Hsu, Otterburn Park, both of Canada; Ray Oliver, Norton, United Kingdom

[73] Assignees: Imperial Chemical Industries PLC, London, United Kingdom; ICI Canada Inc., Ontario, Canada

[21] Appl. No.: 621,193

[22] Filed: Mar. 21, 1996

[30] Foreign Application Priority Data

Mar. 21, 1995 [GB] United Kingdom ..... 9505623

[51] Int. Cl.[6] ..... C06B 21/00; C06B 35/00

[52] U.S. Cl. ..... 149/109.6; 149/35

[58] Field of Search ..... 149/35, 109.6

[56] References Cited

U.S. PATENT DOCUMENTS

| | | | |
|---|---|---|---|
| 4,696,705 | 9/1987 | Hamilton | 149/35 |
| 5,051,143 | 9/1991 | Goetz | 149/35 |
| 5,074,940 | 12/1991 | Ochi et al. | 149/35 |
| 5,387,296 | 2/1995 | Taylor et al. | 149/35 |
| 5,470,406 | 11/1995 | Ochi et al. | 149/35 |
| 5,542,997 | 8/1996 | Zeuner et al. | 149/35 |

*Primary Examiner*—Edward A. Miller

[57] ABSTRACT

A process for the production of a gas-generating composition containing a redox-couple including a water soluble azide component, for example, azide of sodium, potassium, lithium, calcium or barium, and an oxidizer component, for example, sodium nitrate, sodium perchlorate, potassium nitrate, potassium perchlorate or an oxide of iron, nickel, vanadium, copper, titanium, manganese, zinc, tantalum, silicon or aluminium, said oxidizer component being capable of reacting with said azide component to generate gas, said process comprising the steps of:

forming an aqueous dispersion of the redox-couple wherein the azide component is totally dissolved and the oxidizer is uniformly dispersed and stabilised in the azide solution;

passing said aqueous dispersion through a spray nozzle to form a stream of droplets; and contacting said droplets with hot air whereby the water is removed to produce solid particles of gas-generating composition.

16 Claims, 2 Drawing Sheets

PROCESS FOR THE PREPARATION OF GAS-GENERATING COMPOSITIONS

FIELD OF INVENTION

This invention relates to a process for the preparation of gas-generating compositions, particularly compositions containing a redox-couple comprising an azide and an oxidizer therefor which on combustion releases nitrogen gas. Such compositions are widely used as propellant compositions to provide gas for the inflation of "air-bags" in vehicle passenger restraint safety systems wherein a charge of the composition is ignited in response to a vehicle collision and the gas produced by the rapid combustion of the composition is fed into the "air-bag".

BACKGROUND OF THE INVENTION

The combustion properties of "air-bag" gas-generating compositions are critical to the successful, timely operation of the air-bag system in the event of a collision. The "air-bag" must be inflated within about 30–40 milliseconds by a steady stream of relatively cool gas in order to avoid damage to the "air-bag" or injury to the vehicle occupants. The gas-generating composition must therefore be easily ignitable and fast burning and the burn rate must be stable, controllable and reproducible. A further requirement is that the inflation gas must not contain any significant amount of toxic substance and therefore the production of dangerous substances must be avoided or, if produced, must be filtered out of the gas stream.

The gas generating compositions currently favoured comprise azide containing redox-systems based, for example on azides such as alkali and alkaline earth metal azides mixed with metal oxides, for example oxides of iron, aluminium, copper or silicon which react with the azide to produce heat and generate nitrogen gas. The preferred compositions are based on sodium azide, the preferred oxidizing component comprising ferric oxide. Such compositions may also advantageously contain up to about 15% of silicon dioxide to combine with the sodium oxide produced from the sodium azide and form an easily removable slag.

In order to meet the stringent requirements of "air-bag" inflation systems the ingredients must be very finely divided and intimately and uniformly intermixed. Poor mixing and/or the presence of the azide component in excessively large particles will result in incomplete reaction and the presence of combustible and toxic materials such as sodium metal in the combustion products. For complete reaction a necessary requirement is that the degree of mixing must establish the ingredients in the formulation proportions within a space defined by a linear dimension of one reaction zone width, which, in an azide gas-generating composition, is about 20 μm. Completeness of reaction is also dependent on the diffusion time required for the ingredients within the reaction zone to diffuse together, as the reaction will only be complete if the diffusion time is significantly less than the time required for the reaction to traverse the width of the reaction zone. The diffusion time is determined by the size and distance between the particles of ingredients. Accordingly the completeness of reaction is improved by reducing the particle size and increasing the degree of mixing of the ingredients.

Various processes have hitherto been used for the preparation of gas-generating compositions in order to obtain the compositions in the required form of intimately mixed fine particles. Many of the prior art processes have been based on grinding the ingredients singly or together, mixing the ingredients and compacting the composition into pellets or grains for incorporation in a gas-generating charge. The grinding can be effected either in a dry process as exemplified by the processes described in U.S. Pat. Nos. 3,895,098, 4,203,787, 4,243,443 and 4,376,002 or in a wet process as described in U.S. Pat. Nos. 5,074,940, 4,999,063 and 4,547,235.

In a modification of the wet process, described for example in U.S. Pat. Nos. 5,143,567 and 5,223,184, the ingredients are ground in a wet slurry and spray-dried, the particle size of the ingredients, particularly the azide component, being determined by the grinding operation and not by the drying operation. These grinding processes provide little control over the particle size distribution and invariably produce a high proportion of comparatively large particles of the azide component which cannot be mixed intimately with the finer oxide component. The compositions therefore do not react completely and have erratic burning rates. Moreover in the dry grinding process there is an inherent risk of fire or dust explosion.

In a further process, azide based gas-generating redox-couple compositions have been prepared by dissolving the azide component in water, dispersing or dissolving the oxidizer component in the azide solution and precipitating the azide by mixing the solution or dispersion with a non-solvent for the azide such as alcohol. Such processes are described in U.S. Pat. Nos. 4,021,275 and United Kingdom Patents Nos. GB2270686 and GB2278840. Disadvantages of such processes are the costs involved in solvent recovery, inefficient azide recovery and the fire risk involved with the use of inflammable solvents.

In a further process described in German Patent 4133595, a gas generating composition has been prepared by dispersing insoluble oxide in a hot solution of azide component, precipitating the azide by cooling and separating the solid particles from the supernatant liquor. This process is expensive to operate because of the inefficient recovery of the azide. The particle size of the precipitated azide cannot be controlled so that the products contain a high proportion of excessively large particles which will result in incomplete reaction and erratic burning rate.

SUMMARY OF THE INVENTION

It is an object of the present invention to provide a safe and efficient process for the preparation of an azide based gas-generating composition which will give a product having the necessary small particle sizes and intimacy of mixing of the ingredients to render it suitable for gas-generation for "air-bag" inflation.

We have found that, in the preparation of an azide based gas-generating composition, it is advantageous to dissolve the azide completely in water wherein the oxidizer is dissolved or dispersed and subsequently spray-dry the solution or dispersion.

Accordingly the present invention consists in a process for the production of a gas-generating composition containing a redox-couple comprising a water-soluble azide component and an oxidizer component capable of reacting with said azide component to generate gas, which process comprises the steps of forming an aqueous dispersion of said redox-couple wherein the azide component is totally dissolved and the oxidizer component is uniformly dispersed and stabilised in the azide solution either in solution or as a stable dispersion of solid particles in the azide solution; passing said aqueous dispersion through a spray nozzle to form a stream of droplets; and contacting said droplets with hot air whereby the water is removed from the droplets to produce solid particles of the gas-generating composition.

The azide component preferably comprises an azide of an alkali metal or an alkaline earth metal, for example sodium, potassium, lithium, calcium or barium, the most preferred azide being sodium azide. The oxidizer may, if desired, be a water soluble oxidizing compound such as, for example, a nitrate or perchlorate, for example sodium or potassium nitrate or perchlorate. In this case the particles produced from the spray-dried droplets comprise aggregates of very fine mixed crystals of the redox-couple having a primary crystal size of about 0.5–5 μm in the thinnest dimension and preferably 0.5–1 μm. However, water insoluble oxidizer components are preferred as these can be obtained in very small particle sizes and incorporated in the azide solution to form a slurry, thereby reducing the water content required in the sprayed dispersion. The preferred oxidizer is an oxide of a metal lower in the electromotive series of metals than the metal of the azide compound. Preferred metal oxides comprise oxides of iron, nickel, vanadium, copper, titanium, manganese, zinc, tantalum silicon or aluminium. Of these iron oxide, $Fe_2O_3$, is preferred. This oxide can be readily obtained in finely divided form with particles of 0.1–1.0 μm and preferably 0.1–0.3 μm.

It is advantageous to include in the slurry of the azide component and the metal oxide, a quantity of silica, $SiO_2$ which not only serves as oxidizer component but also serves to thicken the slurry and reduce or prevent migration of the metal oxide in the bulk slurry and slurry droplets and also to react with metal oxide, such as sodium oxide formed in the redox reaction, to form a glassy slag which is easily filtered out of the generated nitrogen gas. The silica should preferably be in very fine form. Suitable grades of silica having a particle size of 0.007–0.02 μm are readily available.

The preferred redox-couple comprises 50–70 parts by weight and more preferably 60–70 parts by weight, of sodium azide, 20–30 parts by weight of iron oxide, $Fe_2O_3$ and 5–14 parts by weight of silica, $SiO_2$. In forming the aqueous dispersion, this composition is mixed into sufficient water to dissolve all the azide component at the spray temperature but the amount of water should be restricted to a convenient minimum in order to minimise the amount of water to be evaporated in the spray-drying process. Conveniently the dispersion may contain 100 parts by weight of water for each 30–45 parts by weight of azide component.

The oxidizer component may be uniformly dispersed in the azide solution by vigorous agitation of the dispersion until all the particles of oxidizer are separated to a sufficient degree as may be indicated, in the case of water insoluble oxidizers, by the viscosity of the dispersion, which will reach a minimum. This minimum is an indication that the maximum degree of dispersion of the oxidizer has been reached. In order to achieve efficient dispersion a high shear mixer is preferred. The viscosity of the dispersion should be sufficiently high to prevent any substantial migration (fall-out) of the solid particles (e.g. iron oxide) from the bulk dispersion of the droplets.

In the droplet formation step the aqueous dispersion of the redox-couple may conveniently be atomised in a spray nozzle into droplets of 40 to 200 μm diameter by forcing the droplets under pressure through a nozzle having one or more orifices of 0.5–2.5 mm in diameter. The droplets are conveniently spray-dried by allowing the droplets to fall into a stream of hot air at a temperature in the range from 80°–250° C., preferably 80°–180° C. The outlet and inlet temperatures of the air stream are necessarily different to achieve the required heat transfer for drying the droplets. The air temperature range quoted here indicates convenient outlet and inlet temperatures respectively.

The particles produced in the process of this invention comprise substantially spherical microporous aggregates of azide crystals in a narrow size distribution within the range required for substantially complete reaction with the oxidizer, for example 20–100 μm diameter, the azide primary crystals being 0.5 to 5 μm and generally 0.5 to 1 μm in the thinnest dimension. Generally any solid oxidizer particles are encapsulated by the azide crystals and are considered to serve as crystal growth sites for the azide crystals. The process produces very little ultrafine dust which could be hazardous in subsequent processing operations. The product is readily pressed into pellets or grains for use in a gas-generating charge for "air-bags". The pressing operation can be facilitated by mixing the spray-dried redox particles with a quantity of water or other pressing aid such as graphite powder. The water is advantageously provided in the form of a mixture of water and hydrophobic fumed silicon which may be incorporated into the redox composition with a high shear mixer. The composition can then be pressed to a convenient density of 2.0 to 2.2 g/cc into pellets or grains which can be readily ignited by a conventional igniter such as an electric squib or, more efficiently, by an igniferous booster comprising pyrotechnic sheet material consisting of an oxidizing film, for example of polytetrafluoroethylene coated with a layer of oxidizable metal, for example magnesium, as described in European Patent Publication No. 505024.

SPECIFIC EXAMPLES

The invention is further illustrated by the following Examples in which all parts and percentages are given by weight.

Examples 1–5

TABLE 1

| | Examples | | | | | Comparative Examples | |
|---|---|---|---|---|---|---|---|
| Ingredients (%) | 1 | 2 | 3 | 4 | 5 | 6 | 7 |
| $NaN_3$ | 61 | 63 | 63 | 63 | 69 | 64.5 | 64.5 |
| $Fe_2O_3$ | 27 | 27 | 29 | 31 | 29.5 | 26.5 | 26.5 |
| $SiO_2$ | 12 | 10 | 8 | 6 | 1.5 | 9 | 9 |
| Predicted Heat of reaction, kJ/g | 1.60 | 1.51 | 1.38 | 1.26 | 1.07 | 1.47 | 1.47 |
| Experimental linear burn rate, mm/s | 48.2 | 43.7 | 37.8 | 32.8 | 15.0 | 32.8 | 24.4 |

The formulations of Examples 1–5 shown in Table 1 were prepared by dissolving sodium azide in water in the concentration of 44 grams of sodium azide per 100 gm of water. The iron oxide (Harcros R-1599D, particle size 0.2 μm) and the silica (CAB-O-SIL type M-5 fumed silica by Cabot Corporation, Boston, Mass., nominal particle size 0.014 μm) were added to the solution in a proportion as shown in Table 1. The oxide particles were dispersed uniformly in 70 litres of azide solution by a Silverson high shear mixer Model DX (manufactured by Silverson Machines Inc., East Longmeadow, Mass.) at mixing speed of 3000 rpm. The slurry was pumped into a NIRO Minor-5 spray dryer (manufactured by NIRO Inc., Columbia, Md.) through a two fluid nozzle (type 06—06) having aperture diameter of 2.18 mm, into a counter-current of air introduced through a 4.47 mm diameter nozzle. The inlet air temperature of the spray dryer was 180° C. and the outlet air temperature was controlled to be 100° C. The residence time of the formulation in the air stream was approximately 11 seconds. The product powder was collected and a small quantity of moisture (2% by weight) was mixed into the powder as a binder and pressing aid. The moisture was prepared by mixing 28.5 g of hydrophobic silica (TULLANOX-500 by Tulco Inc. under a license from Cabot Corporation, Boston, Mass.) in 100 ml of water in a high speed blender. The moisture produced in this way had the consistency of fine powder and can be easily incorporated into and mixed thoroughly with the pyrotechnic powder produced in these Examples. The powder was pressed in a hydraulic press under a pressure of 138 MPa and a dwell time of 3 seconds into cylinders of 12.5 mm diameter and 12.5 mm length. The pressed cylinders were then dried in an oven to reduce the moisture to less than 0.1%. The dried cylinders had nominal densities of 2 g/cc. The curved side and one flat end of the cylinder were inhibited by a coat of epoxy thermoset to prevent premature ignition. The cylinders were burnt in a 1.8 litre pressure vessel under a nitrogen atmosphere of 6.9 MPa initial pressure. The uncoated end of the cylinder was ignited by a squib. The time to complete combustion was determined from the pressure record and the burn rate was calculated by dividing the length of the cylinder by the burning time. The results are shown in Table 1. The experimental burn rates were found to be a function of the predicted reaction energies and they increased with an increase in the reaction energy of the formulation. The slags from the tests were placed in water. They produced no sodium flame commonly observed in similar formulations produced by other conventional processes. This is strong proof of the very high degree of mixing achievable with the present process.

BRIEF DESCRIPTION OF THE DRAWINGS

A photomicrograph of the product of Example 5 is shown in FIG. 1 which shows that the product is in the form of spherical aggregates of up to about 20 μm diameter.

Figure 1:
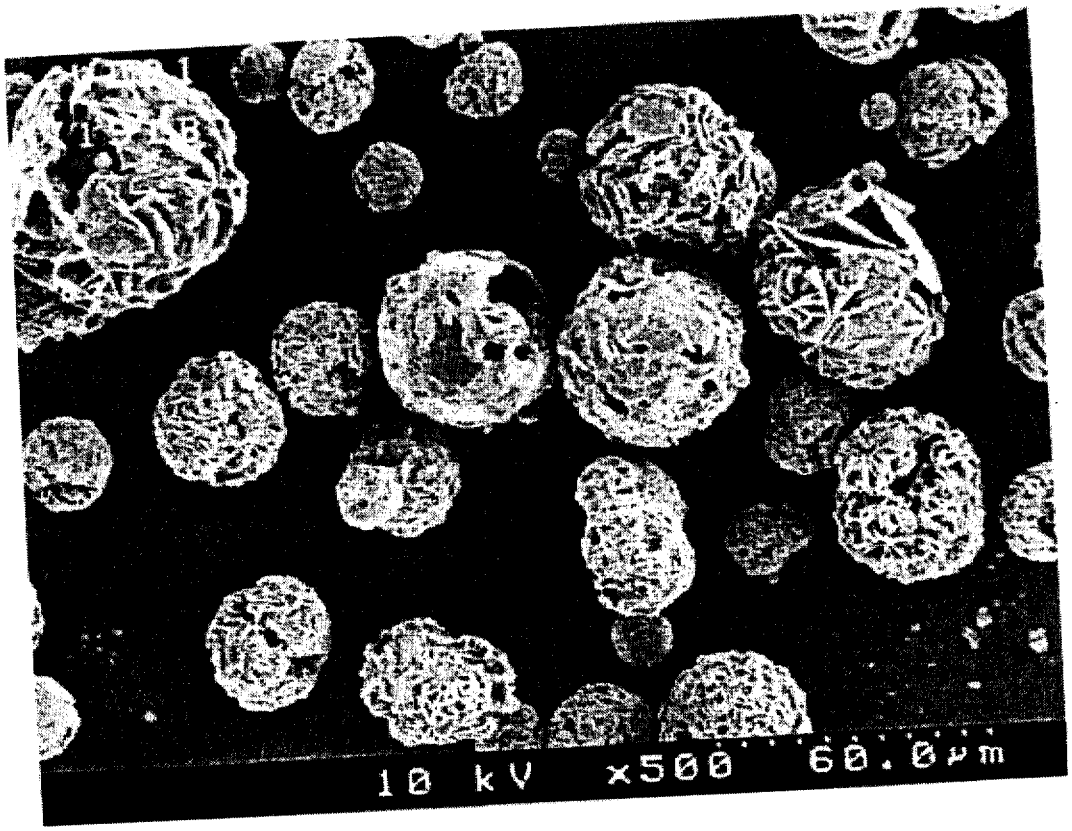
Figure 2:
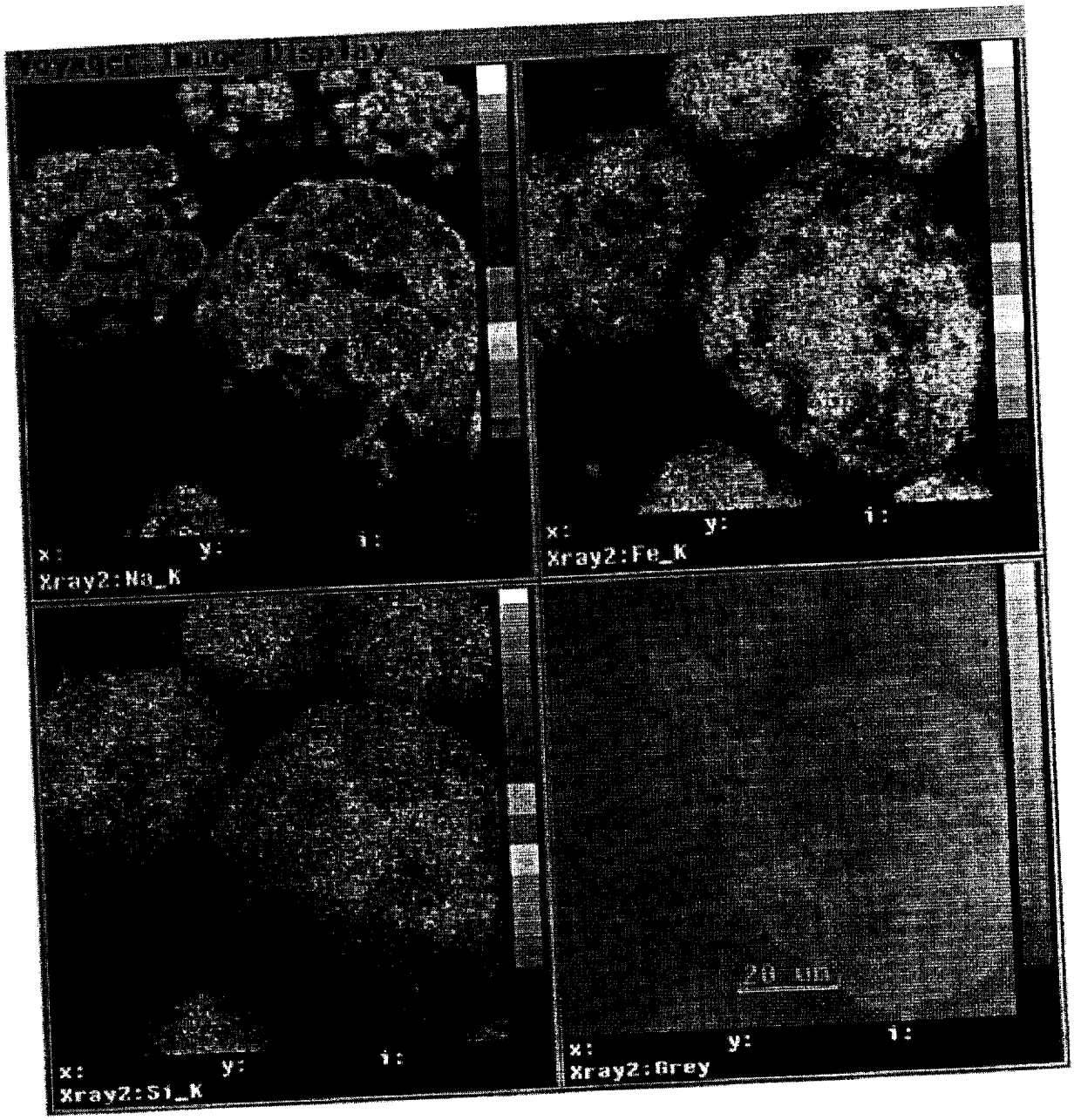
FIG. 2 shows scanning electric-microscope x-ray concentration maps for the product of Example 3.

These maps indicate the concentrations of the three elements Na, Fe and Si and provide visual proof of the high degree of uniformity of the distribution of the three ingredients, NaN3, $Fe_2O_3$ and $SiO_2$ respectively in the spray-dried granules.

Comparative Example 6 (Table 1)

40 grams of sodium, 16.4 grams of iron oxide (Harcros R-1599D) and 5.6 grams of silicon dioxide (CAB-O-SIL M-5) were mechanically combined and ball-milled. The same process as in the previous examples was used to prepare the sample for burn rate measurement. The resultant linear burn rate was 32.8 mm/s, which is significantly lower than products produced by the process of the present invention. The slag produced significant amount of sodium flame when placed in water.

Comparative Example 7 (Table 1)

In this example, the same amount of sodium azide, iron oxide and silicon dioxide as used in Example 6 were mixed in 110 ml of water. The mixture was then dried in a steam jacketed vessel. The experimental burn rate was only 24.4 mm/s. Like Comparative Example 6, the slag of the present example also produced large amount of sodium flame when placed in water.

We claim:

1. A process for the production of a gas-generating composition containing a redox-couple comprising a water soluble azide component and an oxidizer component said oxidizer component being capable of reacting with said azide component to generate gas, said process comprising the steps of:

forming an aqueous dispersion of the redox-couple wherein the azide component is totally dissolved and the oxidizer is uniformly dispersed and stabilised in the azide solution;

passing said aqueous dispersion through a spray nozzle to form a stream of droplets: and contacting said droplets with hot air whereby water is removed from the droplets to produce solid particles of gas-generating composition.

2. A process as claimed in claim 1 wherein the said azide component comprises an azide selected from the group consisting of alkali metal azides and alkaline earth metal azides.

3. A process as claimed in claim 2 wherein said azide is selected from the group consisting of the azides of sodium, potassium, lithium, calcium and barium.

4. A process as claimed in claim 1 wherein said oxidizer component comprises a water-soluble oxidizing compound.

5. A process as claimed in claim 1 wherein the said oxidizer component comprises a water-insoluble oxidizer and the said aqueous dispersion is a slurry of the oxidizer in the azide solution.

6. A process as claimed in claim 1 wherein the oxidizer component comprises an oxide selected from the group consisting of the oxides of iron, nickel, vanadium, copper, titanium, manganese, zinc, tantalum, silicon and aluminium.

7. A process as claimed in claim 6 wherein the oxide particle size is in the range from 0.1 to 1.0 μm. in diameter.

8. A process as claimed in claim 5 wherein silica is incorporated in the aqueous dispersion in sufficient quantity to reduce or prevent migration of the oxidizer component.

9. A process as claimed in claim 8 wherein the silica particles are less than 0.2 μm in diameter.

10. A process as claimed in claim 5 wherein the said aqueous dispersion comprises 50 to 70 parts by weight of sodium azide, 20 to 30 parts by weight of iron oxide and 5 to 14 parts by weight of silica dispersed in sufficient water to dissolve all the azide.

11. A process as claimed in claim 10 wherein the dispersion comprises 100 pairs by weight of water for each 30 to 45 parts by weight of azide.

12. A process as claimed in claim 5 wherein the oxidizer is uniformly dispersed in the azide solution by vigorous agitation until the viscosity of the dispersion is sufficiently high to prevent substantial migration of the oxidizer in the dispersion.

13. A process as claimed in claim 1 wherein the aqueous dispersion is atomised into droplets 40 to 200 μm in diameter by passing the dispersion under pressure through a nozzle having one or more orifices of 0.5 to 2.5 mm in diameter.

14. A process as claimed in claim 1 wherein the droplets are spray-dried by allowing them to fall into a stream of air at a temperature in the range from 80° to 250° C.

15. A process cas claimed in claim 1 wherein the solid particulate gas-generating composition is pressed into pellets or grains.

16. A process as claimed in claim 15 wherein the said gas-generating composition is mixed before pressing with a pressing agent selected from the group consisting of graphite and mixtures of water and hydrophobic fumed silica.

* * * * *

UNITED STATES PATENT AND TRADEMARK OFFICE

CERTIFICATE OF CORRECTION

PATENT NO. : 5,756,930

DATED : May 26, 1998

INVENTOR(S) : Chan, et. al.

It is certified that error appears in the above-identified patent and that said Letters Patent is hereby corrected as shown below:

Title page, item [56] under "References Cited U.S. PATENT DOCUMENTS" please add
4,836,255 6/1989 Schneiter et al.

Title page, item [56] under "References Cited" please add
FOREIGN PATENT DOCUMENTS 0 554 999 8/1993 EPO
0 603 170 6/1994 EPO
2 278 840 12/1994 Great Britain
WO 95/04014 2/1995 WIPO Title page, item [56] under "References Cited" please add
OTHER PUBLICATIONS
Database WPI Section Ch, Week 8935 Derwent Publications Ltd., London, GB; Class L02, AN 89-252303, XP002006884 & JP-A-01 183 403 (Idemitsu Kosan KK), July 1989, ABSTRACT Signed and Sealed this Fourth Day of April, 2000

*Attest:*

*Attesting Officer*

Q. TODD DICKINSON

*Director of Patents and Trademarks*